US009215920B2

(12) United States Patent
Dobler et al.

(10) Patent No.: US 9,215,920 B2
(45) Date of Patent: Dec. 22, 2015

(54) APPLICATOR FOR COSMETICS PRODUCTS

(75) Inventors: Sven Dobler, Huntington, NY (US); Dale Beal, Farmingdale, NY (US)

(73) Assignees: Orlandi, Inc., Farmington, NY (US), part interest; Dela, Corp., Farmington, NY (US), part interest ( * ) Notice: Subject to any disclaimer, the term of this patent is extended or adjusted under 35 U.S.C. 154(b) by 1987 days.

(21) Appl. No.: 11/899,718

(22) Filed: Sep. 7, 2007

(65) Prior Publication Data

US 2008/0083423 A1 Apr. 10, 2008

Related U.S. Application Data

(63) Continuation of application No. 11/190,752, filed on Jul. 27, 2005, now abandoned.

(60) Provisional application No. 60/598,013, filed on Aug. 2, 2004.

(51) Int. Cl.

| | |
|---|---|
| ***A45D 40/26*** | (2006.01) |
| ***A45D 40/00*** | (2006.01) |
| *A45D 40/30* | (2006.01) |

(52) U.S. Cl.

CPC ..... *A45D 40/0087* (2013.01); *A45D 40/26* (2013.01); *A45D 40/30* (2013.01); *A45D 2200/1027* (2013.01); *A45D 2200/1036* (2013.01)

(58) Field of Classification Search

USPC ..... 132/320, 317, 319; 401/7; 206/581, 206/823, 104, 106

See application file for complete search history.

(56) References Cited

U.S. PATENT DOCUMENTS

| | | | | |
|---|---|---|---|---|
| 2,419,896 | A * | 4/1947 | Hobelmann | 401/7 |
| 3,308,837 | A * | 3/1967 | Selleck | 15/104.94 |
| 3,438,486 | A * | 4/1969 | Pinkas | 206/104 |
| 4,006,819 | A * | 2/1977 | Elliott | 206/104 |
| 4,611,611 | A * | 9/1986 | Beal, Jr. | 132/320 |
| 4,995,408 | A | 2/1991 | Wallschlaeger | |
| 5,137,040 | A | 8/1992 | Iosilevich et al. | |
| 5,396,913 | A | 3/1995 | Wallschlaeger | |
| 5,971,138 | A | 10/1999 | Soughan | |
| 6,530,379 | B2 | 3/2003 | Iosilevich et al. | |
| 2008/0245381 | A1 | 10/2008 | Iosilevich et al. | |
| 2008/0248262 | A1 | 10/2008 | Iosilevich et al. | |
| 2009/0053416 | A1 | 2/2009 | Iosilevich | |

* cited by examiner

*Primary Examiner* — Robyn Doan
(74) *Attorney, Agent, or Firm* — Paul M Denk

(57) ABSTRACT

This applicator for cosmetic products, or lipstick, is a single or multiple ply card with an embossed pattern that retains a sample of lipstick from a separate container. The pattern shears lipstick from a tube onto the applicator. Also, the pattern assists a consumer in placing the cosmetic upon the applicator. In use, a woman selects a lipstick and moves the applicator, with the raised pattern, or field, down, across the lipstick source. The lipstick collects between the embossing of the raised field. A woman folds the applicator, moves it to her mouth, and transfers the sample to her lips. Following use, a woman reverse folds the applicator and encloses the raised field and sample residue for disposal.

3 Claims, 1 Drawing Sheet

APPLICATOR FOR COSMETICS PRODUCTS

CROSS REFERENCE TO RELATED APPLICATION

This non provisional patent application claims priority to the non-provisional patent application having Ser. No. 11/190,752, which was filed on Jul. 27, 2005, which claims priority to the provisional patent application having Ser. No. 60/598,013, which was filed on Aug. 2, 2004.

BACKGROUND OF THE INVENTION

This applicator for cosmetic products relates to sampling devices and more specifically to an improved card for applying lipstick. A unique aspect of the present applicator is a raised field that shears and collects a sample of a cosmetic.

People have adorned themselves with perfumes, colognes, powders, mascaras, and other cosmetics for centuries. Samples of a cosmetic encourage more sales to discriminating customers. The counter, where the customer may purchase, remains the most effective place to promote cosmetics. Often, retailers and suppliers of cosmetics provide free samples to entice women. However, women approach some cosmetic products skeptically, like lipstick. Women only buy lipstick after sampling it to judge its desirability. Women also know of the health risks in sampling a lipstick from a common sampler. Multiple uses of a cosmetic sampler invite customer complaints. Sampling a lipstick from a common tube by more than one person has become socially and medically frowned upon. Many women insist upon sampling from an unopened tube of lipstick or sample on their hand to avoid medical problems.

To overcome the health risks in cosmetic sampling, the cosmetic industry has made miniature versions of tubes and other cosmetic dispensers. The miniature versions remain subject to contamination at the retail counter. Further, cosmetic suppliers still incur the cost of producing and distributing the miniature samples for each of the color or product line variations. In addition, cosmetic suppliers and retailers have tried cotton swabs that dab from a common cosmetic source, sample sticks, and test strips. These alternatives when used commercially caused messes, inconvenienced customers, and proved ineffective.

Beyond test strips, tubes, and pencils, the cosmetic industry seeks an inexpensive applicator for applying a cosmetic sample to skin in a single stroke. Presently, cosmetics such as lipstick have individual applicators that indirectly place lipstick upon the lips of a woman. When applied, the lipstick sample should have the same texture, feel, and characteristics regardless of the applicator. Because of the goal for similarity between a sample and the lipstick for sale, applicators usually are miniature tubes or brushes despite other possibilities.

The U.S. patent to Wallschlaeger, U.S. Pat. No. 5,396,913, describes a lipstick applicator of a base support, that does not absorb dry solids and liquids, and a coating of lipstick of 5 mils or less. The base support is not a tube or brush, as is commonly associated with lipstick but rather a planar sheet. The lipstick coating is applied to the base support using screen printing methods. The base support may have a cover thereupon to protect the coating from handling.

The U.S. patent to Wallschlaeger, U.S. Pat. No. 4,995,408, then describes a two ply cosmetic sampler. Wallschlaeger's sampler has projections extending upwardly from the base ply where gravity and friction retain the cosmetic within the projections and upon the base ply. Wallschlaeger presents the sampler as a separate stand alone device loaded with a cosmetic beneath a cover upon the projections of the bottom ply. In use, Wallschlaeger's sampler has the top ply detach, similar to a cover, and separate from the bottom ply so the consumer can use the top ply as an applicator of cosmetic retained in the bottom ply and when finished, the top ply is disposed. In contrast, the present invention has individual separated bosses or projections upon the bottom ply without a cosmetic sample loaded thereon.

Wallschlaeger places a series of projections 3 almost entirely through the surface of the card 15, and then the cosmetic layer of lipstick is deposited thereupon, in the shape of the lips as shown at 19 and 20. The lips shape indicates that when the lipstick cosmetic sample is applied, it is applied in the shape of lips to the shown card 15, even though the series of projections 3 extend throughout the entire surface of the card. Wallshclaeger arranges the projections in a pattern of repeating diagonal line across the fold line, nearly across the width of the base support. When Wallschlaeger folds the base support, the lines of projections intersect, spacing apart the halves of the cosmetic sample. Hence, the minimal guidance in Wallschlaeger as to how the lipstick is to be applied includes attempting to apply it to the series of projections upon the surface of the card and in the shape of a pair of lips.

As can be seen from the Applicants' invention, and as described, the present invention only includes the raised field 3 in the shape of the lips, and excludes a cosmetic sample packaged with the applicator. Here, an applicator is withdrawn from a supply of the same, the applicator is the dragged across a bulk lipstick source, and the lipstick only retains within the raised field, shaped as upper and lower lips. This usage of the present invention therefore, provides guidance as to the application of the lipstick, to the applicator, only in the portion where needed. The present invention retains the suitable amount of lipstick for a sample application by a woman, and does not use excessive lipstick, or less than needed, within the shape of the lips provided upon the applicator through the raised field 3.

Furthermore, Wallschlaeger provides the projections in the base support while the present invention includes one or more laminated sub-plies which form the raised pattern in the shape of the upper and lower lips of the user. The present invention also provides notches upon the side edges or perimeter of the card where Wallschlaeger does not. Once the applicator has been used, it can be reverse folded to close the card and the lipstick applied raised areas are now on the interior of the card. The peripheral notches on the card then conceal the remaining lipstick, and prevent its accidental application, or staining, to some other area or unauthorized contact after usage.

And, the U.S. Pat. No. to Soughan U.S. Pat. No. 5,971,138 provides a train of envelopes in roll form that dispense premoistened towelettes. The notches of Soughan are identified as the hook or catch 30, that sever the sections 16 of the formed envelopes as they are pulled from the roll 10. The notches 6 provided within Applicants' design have a very specific purpose, locking the folded card, which is just not mentioned in Soughan.

The present art overcomes the limitations of the prior art. That is, in the art of the present invention, a single use applicator for cosmetic products, receives lipstick from a common bulk container but allows each woman to sample the lipstick individually.

The difficulty in providing a removable sampler is shown by the operation of a typical product sample at a cosmetics counter, or department store. The prior art communicates the shade and texture of a particular lipstick. However, most cosmetic suppliers produce about 150 shades of lipstick, making individual counter display and sampling impractical and expensive. Cosmetic suppliers have invested heavily in sampling lipstick tubes and two-ply applicators in use at counters around the world. In addition, lipsticks have a variety of formulae differing in shelf life and compatibility. Lipstick formulae require testing for sample stability during shipping and handling to a retail store. During testing, some samples may render a formula incompatible and deter marketing of a formula. The logistics and expense of testing pose obstacles to cosmetic vendors, raising the cost and time involved in a sampling program. The two ply construction of the prior art—base and cover—, the compatibility and stability testing, shelf space requirements, and packaging make existing applicators more expensive to use in a sampling program.

Embossing in prior art patents, serving as stilting, protects a cosmetic material, or lipstick, between the base ply and the top cover ply. The present invention merely serves as an aid to shear lipstick from a tube. The present invention allows the use of one common card by a woman for all the shades she seeks to sample. The present invention reduces the need for numerous preprinted shade cards. As the woman samples the lipstick immediately after applying it to the present invention, stability and compatibility concerns of the lipstick do not arise.

The present invention overcomes the difficulties of the prior art. The applicator for cosmetic products has a single ply for ease of manufacturing and alternatively, multiple plies. At a display counter, the present invention is easier to use and has less shipping, manufacturing, and storage costs. Combined with lipstick and other sampling components presently at cosmetics' counters, the applicator for cosmetic products readily integrates into existing sampling programs.

SUMMARY OF THE INVENTION

The applicator for cosmetic products is a single or multiple ply card with an embossed pattern and without deposited cosmetic thereon. The pattern forms a friction, or raised, field that shears lipstick when applied directly from a separate source such as a tube or a tube onto the applicator. While the prior art used stilting to separate deposited cosmetic to prevent crushing of the cosmetic, the raised field merely aids the scraping and shearing of lipstick or other cosmetic onto the card of the invention. Also, the pattern of bosses assists the consumer in visually targeting the deposit of a cosmetic upon the applicator.

At a counter, a woman surveys the samples of lipsticks and selects a few of her choosing. The woman takes the present invention with the raised field down, and moves the applicator across the lipstick source. The raised field contacts the lipstick and lipstick collects between the embossing of the raised field. After selecting a sample, a woman folds the applicator away from her, moves the applicator to her mouth, and transfers the sample of lipstick to her lips. Following use, a woman folds the applicator towards her and encloses the raised field.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

Therefore the object of the present invention is to provide one common card suitable for all shades of lipstick thus eliminating a plurality of preprinted cards and the storage and handling of those numerous cards.

Another object of the invention is to provide such a card with a minimum of stability and compatibility concerns with a variety of cosmetics generally sampled at retail locations.

Another object of the present invention is to provide such a card that may be easily and efficiently manufactured and marketed at less cost than existing samplers.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
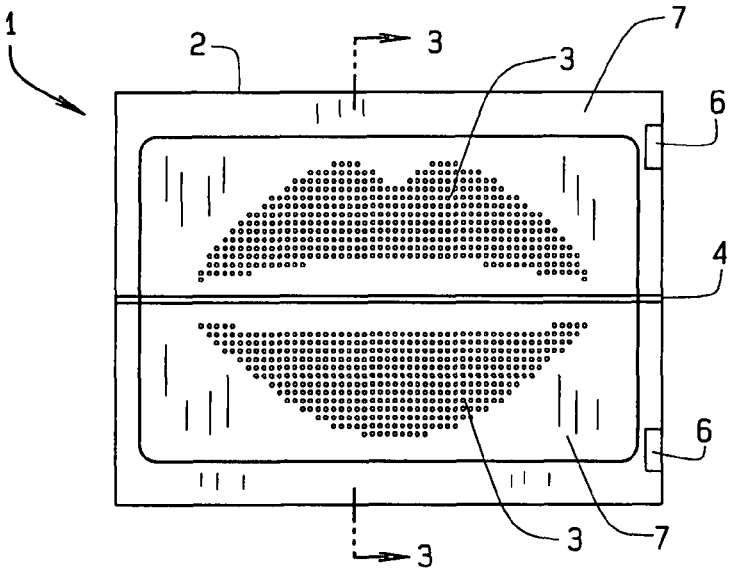
FIG. 1 shows a plan view of the preferred embodiment of the applicator for cosmetic products constructed in accordance with the principles of the present invention.

The present art overcomes the prior art limitations by providing an applicator for cosmetic products that allows multiple consecutive samples to be placed upon a single applicator. Turning to FIG. 1, the preferred embodiment of the applicator 1 for cosmetic products has as a card of a single ply 2 of material generally rectangular in shape. The ply 2 has scoring with a center fold line 4 and a mechanically embossed lip contour pattern 3. Upon the longitudinal axis, the applicator 1 has a centered fold 4 that generally divides the present invention into halves. As a means to secure the applicator 1 when closed, the card 2 has one or more notches 6 upon one or more edges. A die cuts the notches 6 to interlock when one half folds upon the other. Generally centered, an embossed pattern 3 rises from the ply 2. The pattern 3 has the appearance of a pair of lips in a smooth field. In the preferred embodiment, the pattern 3 has a plurality of raised bosses in a grid shaped to mimic lips. The bosses are separated and mutually spaced apart so that cosmetic sample can be collected when the applicator is dragged in either direction upon a cosmetic source. The bosses occupy approximately 25% of the surface area of the ply 2 and have a planar border 7 without bosses surrounding the lip pattern. The pattern 3 rises from the ply 2 somewhat less than three thicknesses of the ply 2, approximately 3 mils in height.

Many methods can form the raised area 3 such as mechanical embossing or printing. A mechanical emboss uses a roller or flat tool with a positive image of the pattern 3. The card 2 passes under a roller or flat embossing tool which impresses the pattern 3 upon the material of the card 2. Printing forms a raised area 3 by its own methods, special inks, and deposition. In general, printing places a pattern 3 of greater height than the card 2 upon the surface of the card 2. Printing includes the methods of silkscreen, offset, rotogravure, flexography, and deposition. In particular, flexography uses conventional inks, offset inks, flexo inks, ultraviolet cured inks, and thermographic heat set inks. The inks adhere to the surface of the card 2 and the lipstick collects between portions of the ink. Deposition places material upon the card 2 in a pattern 3. Deposition involves the methods of thermoforming, vacuum forming, casting, heat treatment, electrostatic treatment, spraying, extruding, adhesives, and cohesives.

Figure 2:
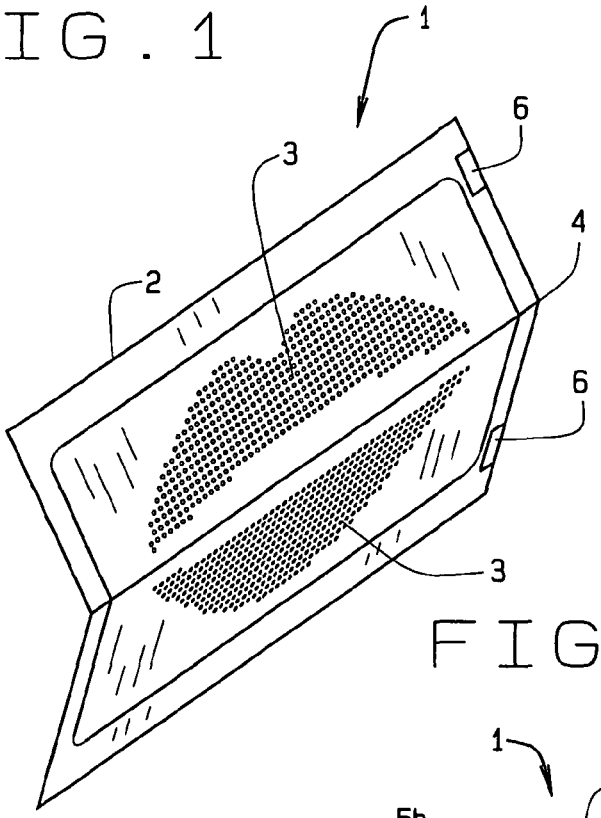
FIG. 2 shows an isometric view of the partially folded applicator of the present invention; and, FIG. 3 describes a sectional end view of the present invention.

As shown in FIG. 2, a woman utilizes the applicator 1 to transfer a sample of cosmetics, or lipstick, to her lips for viewing and shopping. A woman folds the ply 2 along the fold line 4 with the halves folding away from the woman. Upon the halves, the embossed pattern 3 is ready to transfer a cosmetic once in contact with lips.

A salesperson places cosmetic, or lipstick, upon the embossed pattern 3 by either dragging the ply 2 across a lipstick tube or tube or dragging the lipstick tub or tube across the ply 2. The raised pattern 3 retains lipstick between the bosses generally at no more depth than the height of a boss, approximately three mils. With the lipstick upon the ply 2, a woman applies the sample to her lips for possible purchase. After use, a woman folds the card 2 toward her which encases the raised area 3, preventing inadvertent staining. The woman then interlocks the notches 6 to secure the applicator 1 in a closed configuration. The applicator 1 can then be carried by the woman with less risk of the sample leaking from the applicator 1.

Figure 3:
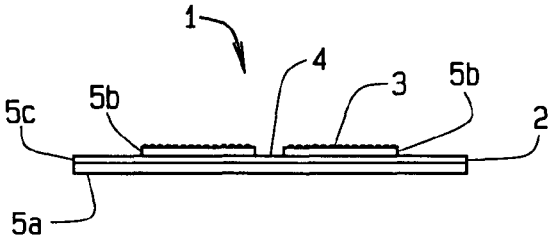

Turning to FIG. 3, an alternate embodiment of the present invention has two or more subplies 5. The first sub-ply 5*a* forms the base of the applicator 1. The first sub-ply 5*a* extends for the complete width and length of the card 2. The first sub-ply 5*a* folds longitudinally along the line 4. Upon both sides of the fold line 4, the applicator 1 has a second sub ply that can be applied singly or in pairs. FIG. 3 shows two sub plies applied above the first sub ply. The second sub-plies 5*b* have less width than half of the card 2 and less length than the card 2. The second sub-plies 5*b* provide the raised field 3 as manufactured by the methods previously described in FIG. 1. The second sub-plies 5*b* are generally spaced apart and symmetrically arranged about the fold line 4. Alternatively, the second sub-plies 5*b* are upon a separate third sub-ply 5*c* that itself joins with the first sub-ply.

Another version of this applicator may be made of material that does not feature a raised or embossed area, as previously described, but may be made of material or has a coating on a material that renders the applicator receptive to the cosmetic sample, and at the same time be relatively impervious to the cosmetic sample so that it does not absorb into or through the applicator before usage. The applicator will still fold over on a pre-creased, printed or perforated line, so that it may function as the original applicator as described herein. Another version may include either a raised or embossed area, or a non raised applicator, with an overlay cover material that is removed prior to usage, to maintain a hygienic deposit area for the cosmetic sampler, when applied.

From the aforementioned description, an applicator for cosmetic products has been described. The applicator for cosmetic products is uniquely capable of collecting a sample of cosmetic, generally lipstick, from bulk containers for each individual shopper to use. The applicator for cosmetic products and its various components may be manufactured from many materials, including but not limited to singly or in combination, paper, cellulose, polymers, polyester, polyethylene, polypropylene, polyurethane, polyvinyl chloride, nylon, Teslin, Saran, open cell foam, closed cell foam, ferrous and non-ferrous metal foils and their alloys, and composites.

We claim:

1. An applicator for transferring a non-liquid cosmetic from a bulk source to a consumer for sampling at the site of usage of said applicator, said sampling being provided upon a selected area of the consumer's body, without staining the remainder of the consumer, comprising:

a card, generally planar, having a raised area and a fold line bisecting said card and said raised area;

said raised area including a pattern of separated individual bosses mutually spaced apart within a border, said pattern having the shape of a pair of lips, with the upper lip positioning above said fold line, and the lower lip positioning below said fold line, said bosses adapted to collect cosmetic from the bulk source;

said raised area adapting to allow the consumer to apply lipstick across the raised area bosses from the bulk source of cosmetic for collecting the cosmetic sample and the placing the cosmetic sample upon a consumer's body for evaluation by the consumer;

said applicator including said card being one ply, said raised areas being two spaced apart second plies, and a third ply affixing to said card, with said second plies adjoining to said third ply wherein said raised area is oriented opposite said card;

said raised area being formed by one of mechanical embossing or printing, wherein said printing being one of silkscreen, offset, rotogravure, or flexography, and said flexography including one of conventional inks, offset inks, flexo inks, ultraviolet cured inks, and thermographic heat set inks;

said card having at least two notches exposed along lateral edges on the perimeter of said card, at least one notch locating above said fold line, and at least one notch locating below said fold line, said notches being aligned for mutual interlocking when a consumer closes said card by folding along said fold line and placing the raise area and any remaining cosmetic on the interior of said card when folded, said notches retaining said card closed after usage of said applicator, and said card when closed resisting inadverted opening and no portion of the perimeter of said card when closed extending outwardly of any other portion of said card.

2. The applicator of claim 1 further comprising:

said raised area occupying approximately 25% of said card;

said card having a thickness; and, said bosses having a height less than three times said thickness of said card.

3. The applicator of claim 1 wherein said printing to form said raised area being formed by deposition, and said deposition includes one of thermal forming, vacuum forming, casting, heat treatment, electrostatic treatment, spraying, extruding, adhesive, or cohesives.

* * * * *